United States Patent [19]

Kitahara et al.

[11] Patent Number: 4,962,391

[45] Date of Patent: Oct. 9, 1990

[54] INK JET PRINTER HEAD

[75] Inventors: Tsuyoshi Kitahara; Shuji Yonekubo; Hideki Morozumi; Koichi Higashimura; Masanao Matsuzawa, all of Suwa, Japan

[73] Assignee: Seiko Epson Corporation, Tokyo, Japan

[21] Appl. No.: 336,964

[22] Filed: Apr. 12, 1989

[30] Foreign Application Priority Data

Apr. 12, 1988 [JP] Japan ..... 63-89372
Jun. 3, 1988 [JP] Japan ..... 63-137888
Jun. 23, 1988 [JP] Japan ..... 63-155891

[51] Int. Cl.[5] ..... B41V 2/045
[52] U.S. Cl. ..... 346/140 R
[58] Field of Search ..... 346/140

[56] References Cited

U.S. PATENT DOCUMENTS 4,072,959 2/1978 Elmquist ..... 346/140
4,209,794 6/1980 Kattner ..... 346/140
4,409,601 10/1983 Nilsson ..... 346/140
4,409,602 10/1983 Nilsson ..... 346/140
4,438,441 3/1984 Bolmgren ..... 346/140
4,539,575 9/1985 Nilsson ..... 346/140
4,564,851 1/1986 Nilsson ..... 346/140

FOREIGN PATENT DOCUMENTS 71569 5/1980 Japan .
114964 7/1983 Japan .

*Primary Examiner*—Joseph W. Hartary
*Attorney, Agent, or Firm*—Blum Kaplan

[57] ABSTRACT

An ink jet print head is provided having a nozzle forming substrate with a plurality of nozzles formed therein. Vibrators formed on a piezoelectric transducer disposed within the ink jet print head opposite the nozzles are independently drivable. A first gap is formed between the nozzle forming substrate and a vibrator in a region adjacent the nozzles. A second gap is formed between the nozzle forming substrate and a vibrator at a region away from the nozzles having a different dimension than the first gap.

14 Claims, 12 Drawing Sheets

FIG. 7a
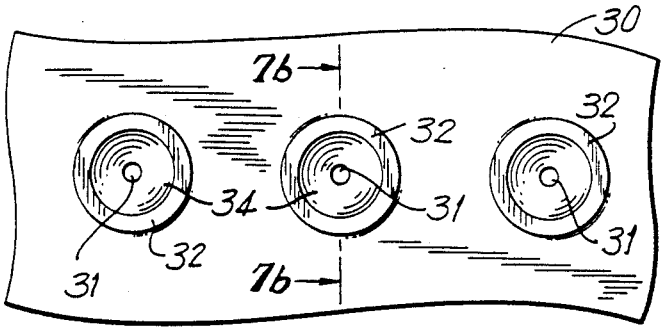
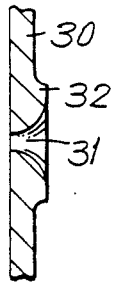
FIG. 7b
FIG. 8a
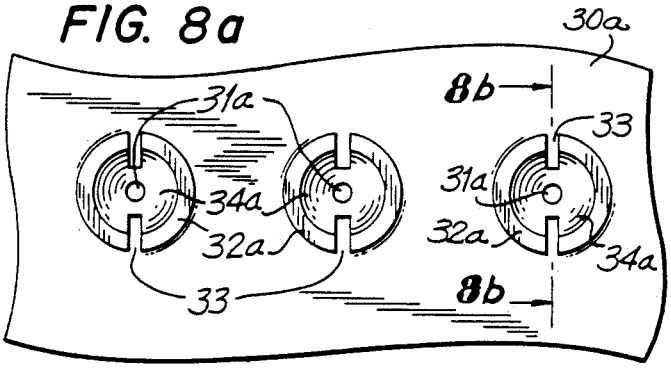
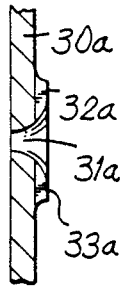
FIG. 8b
FIG. 9a
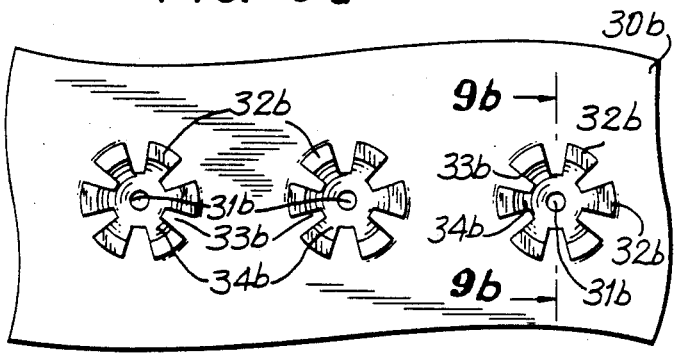
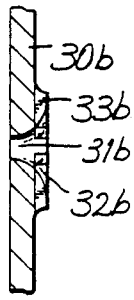
FIG. 9b
FIG. 10a
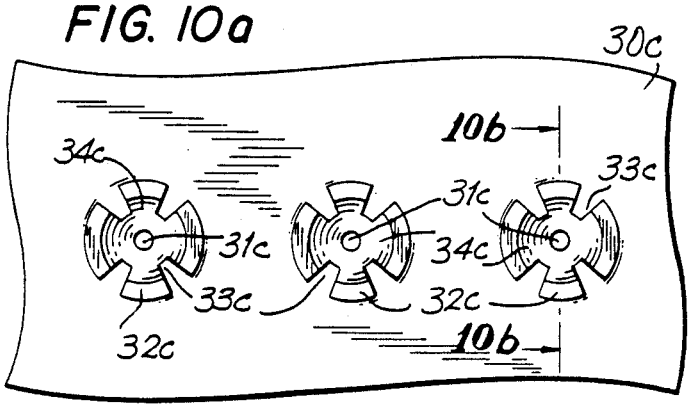
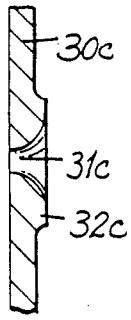
FIG. 10b FIG. 21
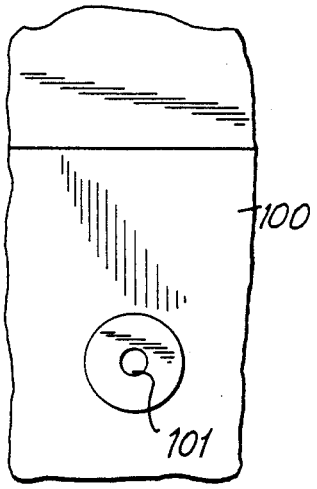
FIG. 22
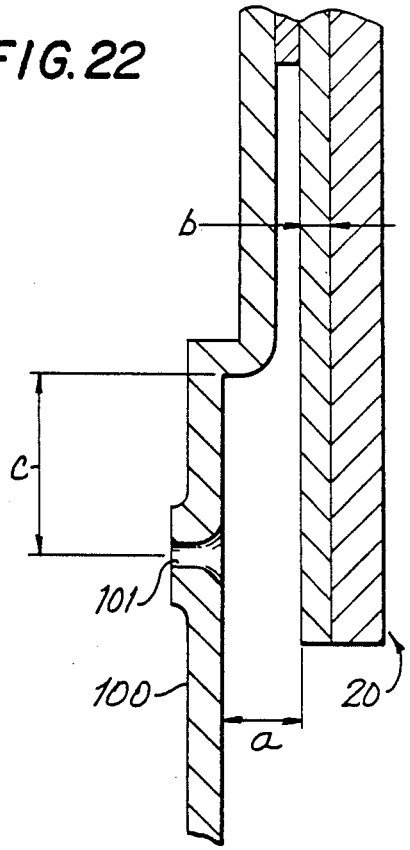
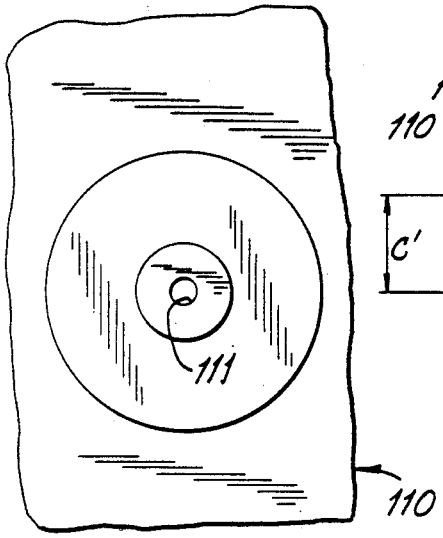
FIG. 23
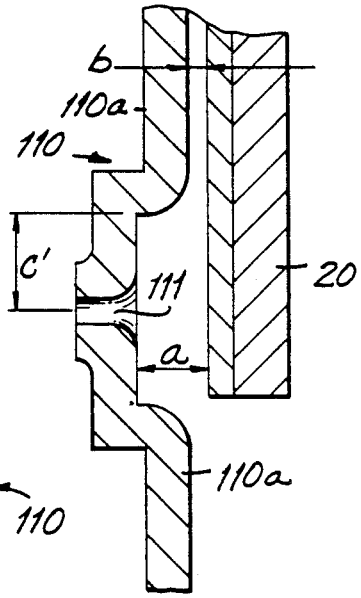
FIG. 24
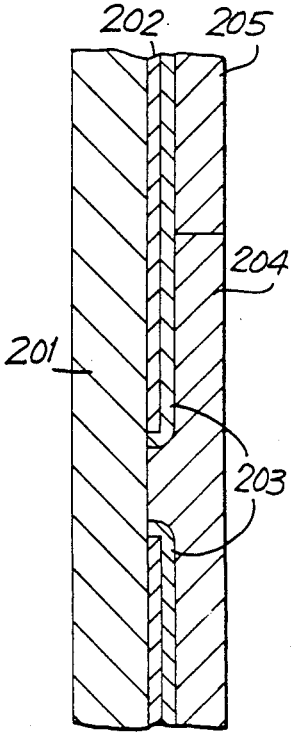
FIG. 25

INK JET PRINTER HEAD

BACKGROUND OF THE INVENTION

The present invention relates to an ink jet printer and, in particular, to an ink jet printer head.

Ink jet printer heads are known in the art as shown by U.S. Pat. No. 4,072,959 and include a plurality of nozzles and a piezoelectric transducer disposed behind the nozzles to apply pressure to ink, forcing ink through the nozzles. The piezoelectric transducer includes a vibrator placed almost rectangularly relative to the nozzle forming substrate and has a cantilever or center beam structure. The ink passages between the nozzles communicate with each other over a short distance.

Because the piezoelectric transducer includes a vibrator displaced almost rectangularly relative to the nozzle forming substrate and short nozzle ink passages, discharge efficiency and ink drop stability is high. Additionally, because the ink passages between nozzles communicate with each other over short distances, foreign matter such as bubbles, dust and the like mixed within the ink do not exert an influence during normal operation of the ink jet head. Moreover, because the vibrator is of a cantilever or center beam structure, electrical-mechanical transduction efficiency is high and the necessary vibrator displacement is obtainable at low voltages.

However, the prior art ink jet print head has been less than satisfactory. The stability of certain characteristics are inherently hard to obtain in the conventional ink jet head printers. The size of a gap formed between the vibrator and the nozzle substrate has an influence on characteristics such as ejection rate, ejection quantity and ejection answerability of ink drops. The gap size tolerance of the prior art ink jet print head is too limited to satisfy all these characteristic requirements. To increase ejection rate and ejection quantity of ink drops, it becomes necessary to maintain a gap between the nozzle forming substrate and the vibrator at an infinitesimal constant range to enhance ink pressure which exists near the nozzles. However, in such an infinitesimal gap, resistance and inertia is applied to the vibrator during displacement due to ink flow generated within the ink which exists in the gap between the vibrator and nozzle forming substrate. Accordingly, the periodic damping state changes to an impracticable setting for proper damping. For example, when subjected to excessive damping, a maximum ink ejection pressure value is minimized and the time required for reaching the maximum discharge pressure is lengthened relative to the situation in which the damping reaches a final displacement keeping a periodic damping having a long time constant. This results in a deterioration of energy efficiency. Additionally, a supply of ink necessary for restoring the nozzle meniscus for the next ink ejection is prevented by the gap between the vibrator and nozzle forming substrate so that the time for ink return within the gap becomes so long that answerability is deteriorated and ejection quantity fluctuation due to frequency becomes unavoidable.

Accordingly, it is desireable to provide an ink jet print head which overcomes the shortcomings of the prior art by controlling the gaps between the nozzle forming substrate and the transducer vibrator.

SUMMARY OF THE INVENTION

Generally speaking, in accordance with the invention, an ink jet head includes a nozzle forming substrate having at least one nozzle formed therein. A piezoelectric transducer having an independently drivable vibrator thereon is positioned across a gap opposite the nozzle. Ink may flow within the gap between the nozzle forming substrate and the piezoelectric transducer. The gap formed between the nozzle forming substrate and the vibrator in a region or neighborhood near the nozzle may be varied from the remainder of the gap formed away from the nozzle. The vibrator is deformed and displaced to eject ink, independently controlling an ejection pressure generation characteristic and a periodic damping characteristic resulting from resistance and inertia from the ink contained within the gap providing an ink jet print head having stable characteristics.

Accordingly, it is an object of the invention to provide an improved ink jet print head.

It is another object of the invention to provide an ink jet print head simultaneously having high energy efficiency and stable ejection rate, ejection quantity and ink drop ejection answerability.

Still another object of the invention is to provide an ink jet print head in which the ejection pressure generation characteristic and periodic damping characteristic can be independently controlled.

Still other objects and advantages of the invention will in part be obvious and will in part be apparent from the specification.

The invention accordingly comprises the features of construction, combinations of elements, and arrangement of parts which will be exemplified in the constructions hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

FIG. *7a* is a front elevational view of another embodiment of a nozzle forming substrate constructed in accordance with the invention;

FIG. *7b* is a sectional view taken along line 7—7 of FIG. *7a;*

FIG. *8a* is a front elevational view of a nozzle forming substrate constructed in accordance with another embodiment of the invention;

FIG. *8b* is a sectional view taken along line 8—8 of FIG. *8a;*

FIG. *9a* is a front elevational view of a nozzle forming substrate constructed in accordance with another embodiment of the invention;

FIG. 9*b* is a sectional view taken along line 9—9 of FIG. 9*a;*

FIG. 10*a* is a front elevational view of a nozzle forming substrate constructed in accordance with another embodiment of the invention;

FIG. 10*b* is a sectional view taken along line 10—10 of FIG. 10*a;*

Figure 11:
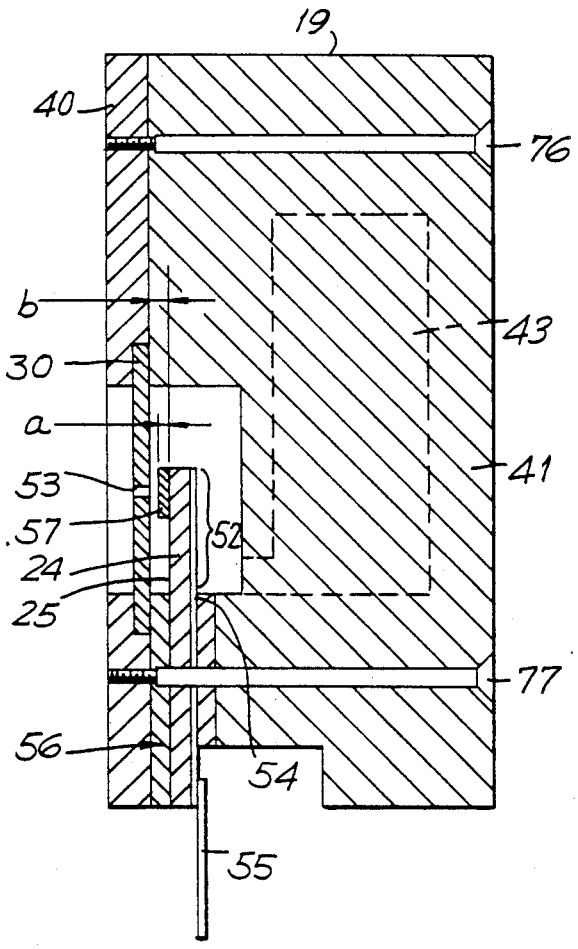
Figure 12:
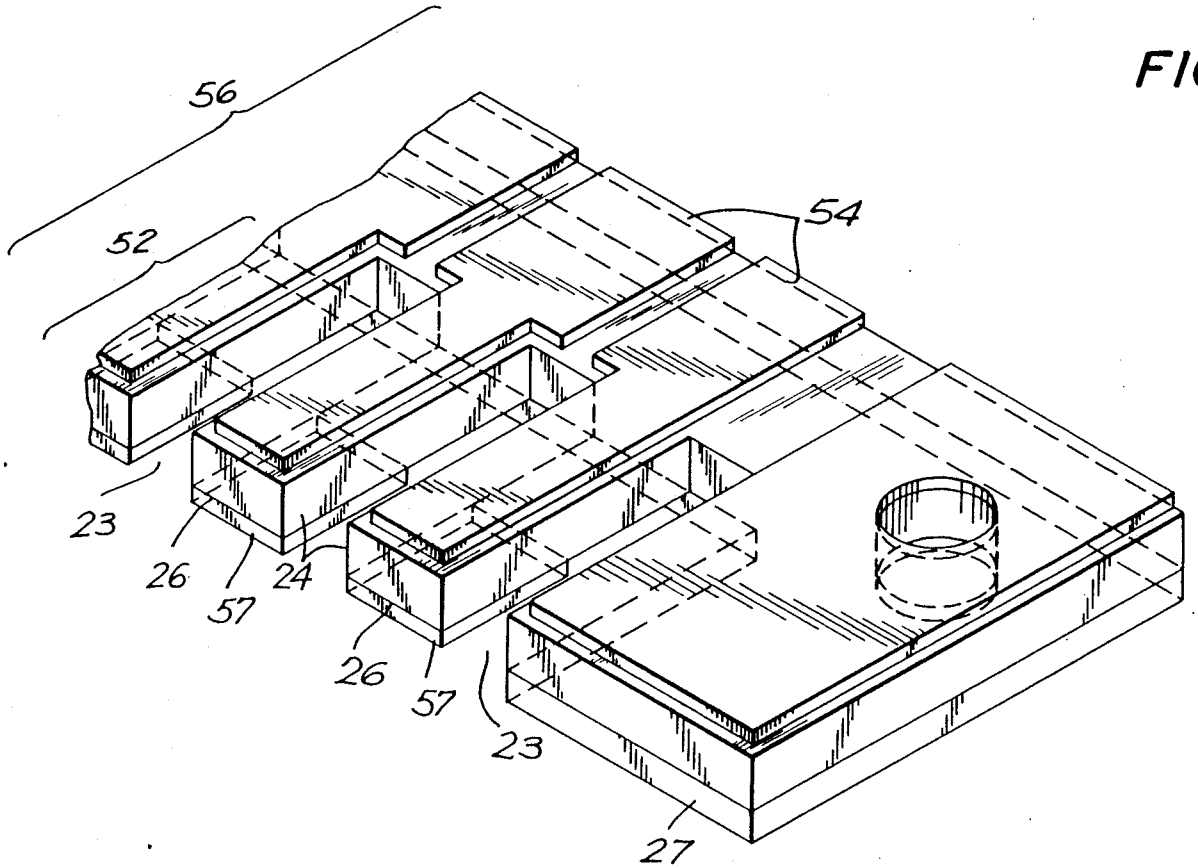
Figure 13:
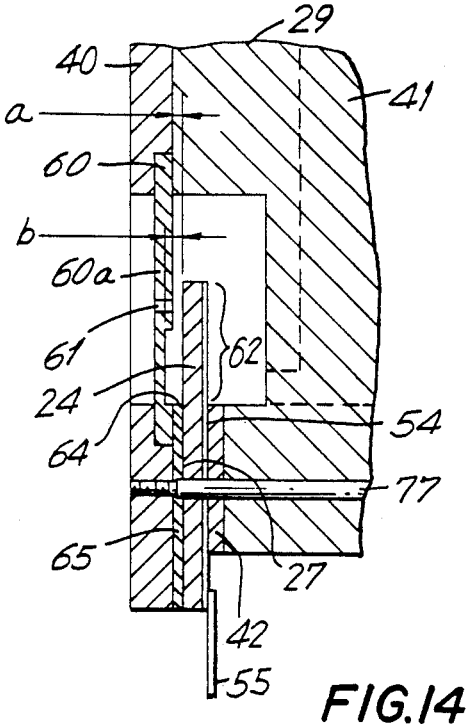
Figure 14:
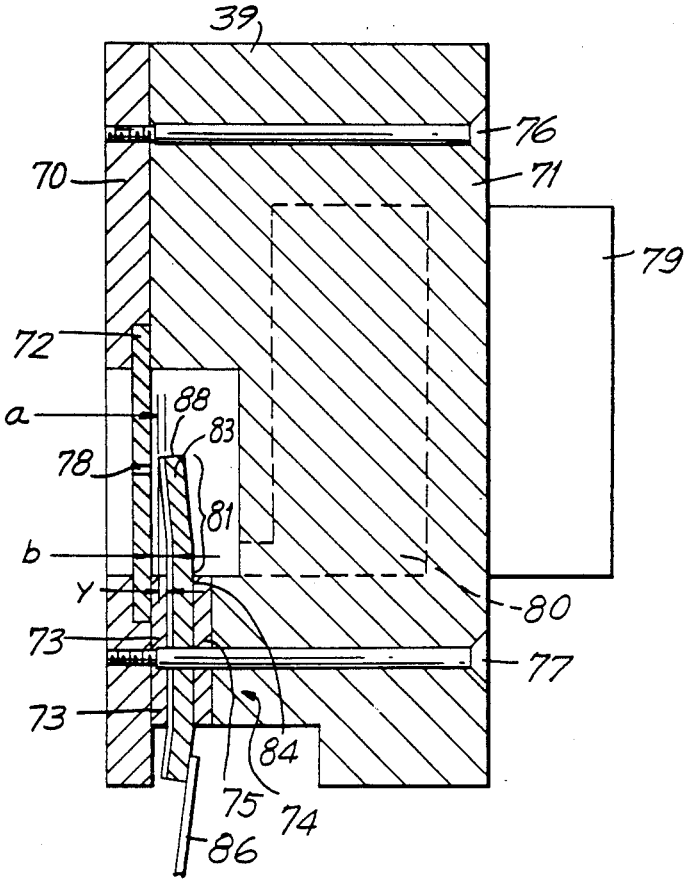
Figure 16A:
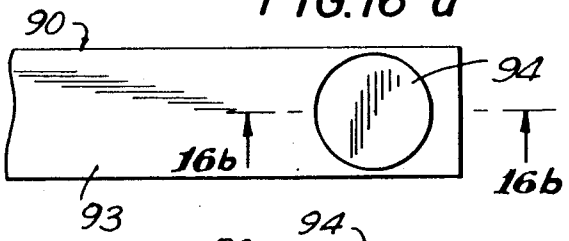
Figure 16B:
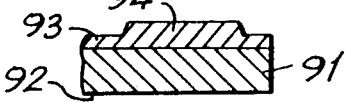
Figure 15:
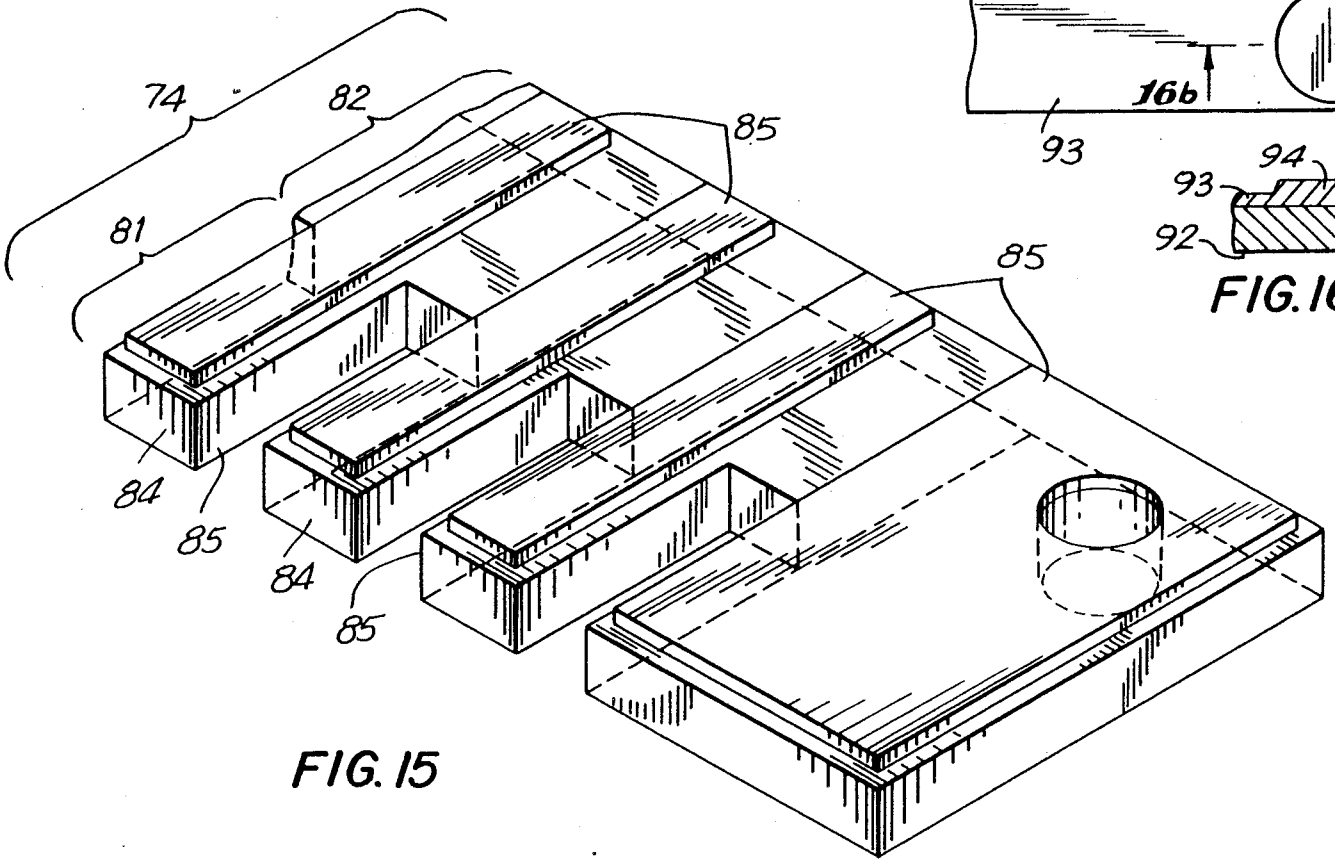

FIG. 11 is a sectional view of an ink jet print head constructed in accordance with a second embodiment of the invention;

FIG. 12 is a perspective view of a piezoelectric transistor constructed in accordance with the second embodiment of the invention;

FIG. 13 is a sectional view of an ink jet print head constructed in accordance with a third embodiment of the invention;

FIG. 14 is a sectional view of an ink jet print head constructed in accordance with a fourth embodiment of the invention;

FIG. 15 is a perspective view of a piezoelectric transducer constructed in accordance with the fourth embodiment of the invention;

FIG. 16*a* is a top plan view of a vibrator constructed in accordance with a fifth embodiment of the invention;

FIG. 16*b* is a sectional view taken along line 16—16 of FIG. 16*a;*

Figure 17:
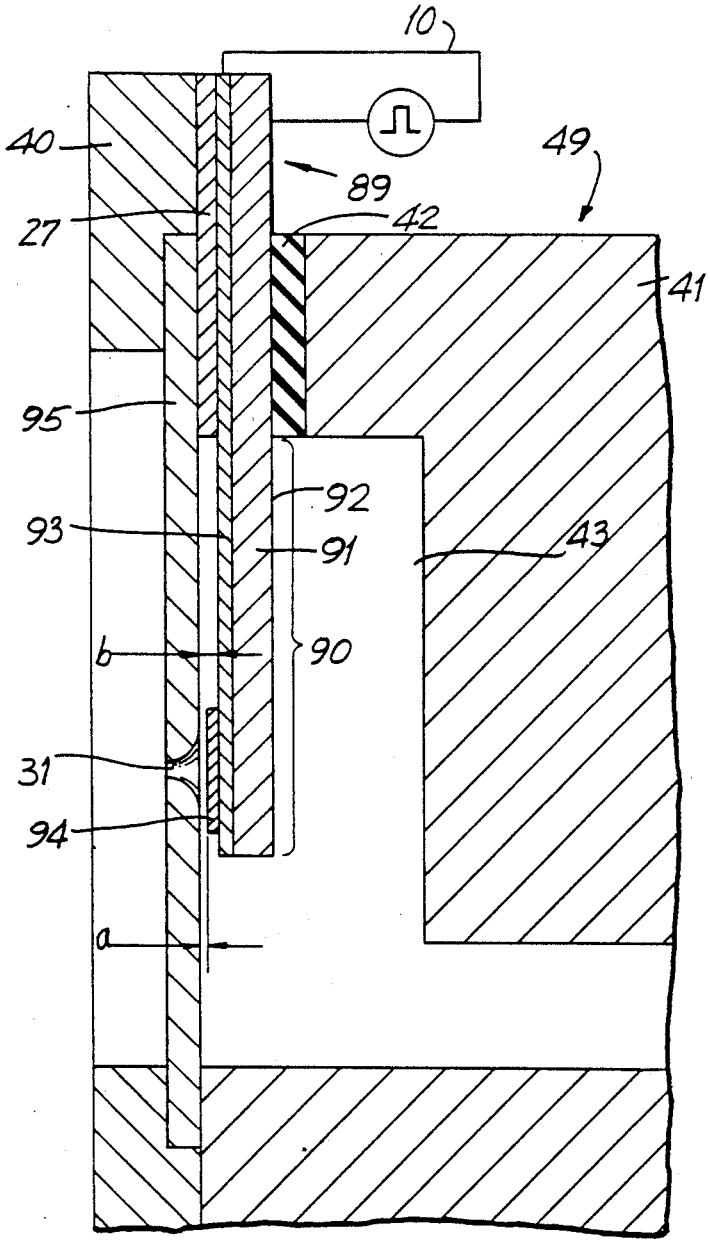
Figure 18A:
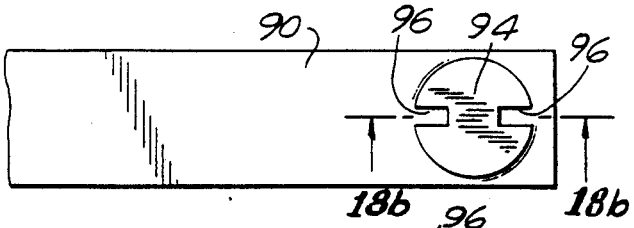
Figure 18B:
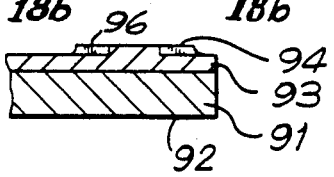

FIG. 17 is a sectional view of an ink jet print head constructed in accordance with the fifth embodiment of the invention;

FIG. 18*a* is a top plan view of a vibrator constructed in accordance with another embodiment of the invention;

FIG. 18*b* is a sectional view taken along line 18—18 of FIG. 18*a;*

Figure 19A:
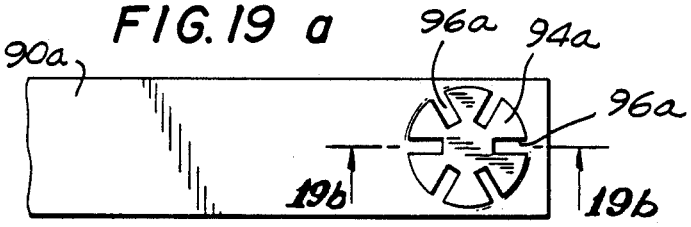
Figure 19B:
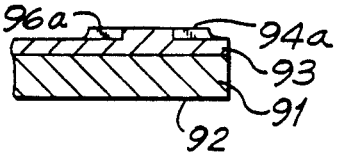

FIG. 19 is a top plan view of a vibrator constructed in accordance with another embodiment of the present invention;

FIG. 19*b* is a sectional view taken along 19—19 of FIG. 19*a;*

Figure 20A:
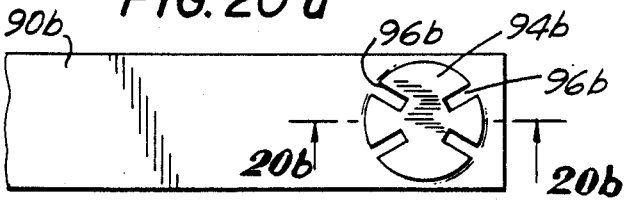
Figure 20B:
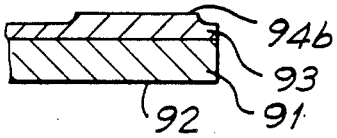

FIG. 20*a* is a top plan view of a vibrator constructed in accordance with another embodiment of the invention;

FIG. 20*b* is a sectional view taken along line 20—20 of FIG. 20*a;*

FIG. 21 is a front elevational view of a nozzle forming substrate constructed in accordance with a sixth embodiment of the invention;

FIG. 22 is a partial sectional view of an ink jet print head constructed in accordance with the sixth embodiment of the invention;

FIG. 23 is a front elevational view of a nozzle forming substrate constructed in accordance with a seventh embodiment of the invention;

FIG. 24 is a partial sectional view of an ink jet print head constructed in accordance with the seventh embodiment of the invention; and FIG. 25 is a side elevational view of a nozzle forming substrate being constructed in accordance with the sixth embodiment of the invention.

DETAILED DESCRIPTION OF THE PREFERRED EMBODIMENTS

Figure 1:
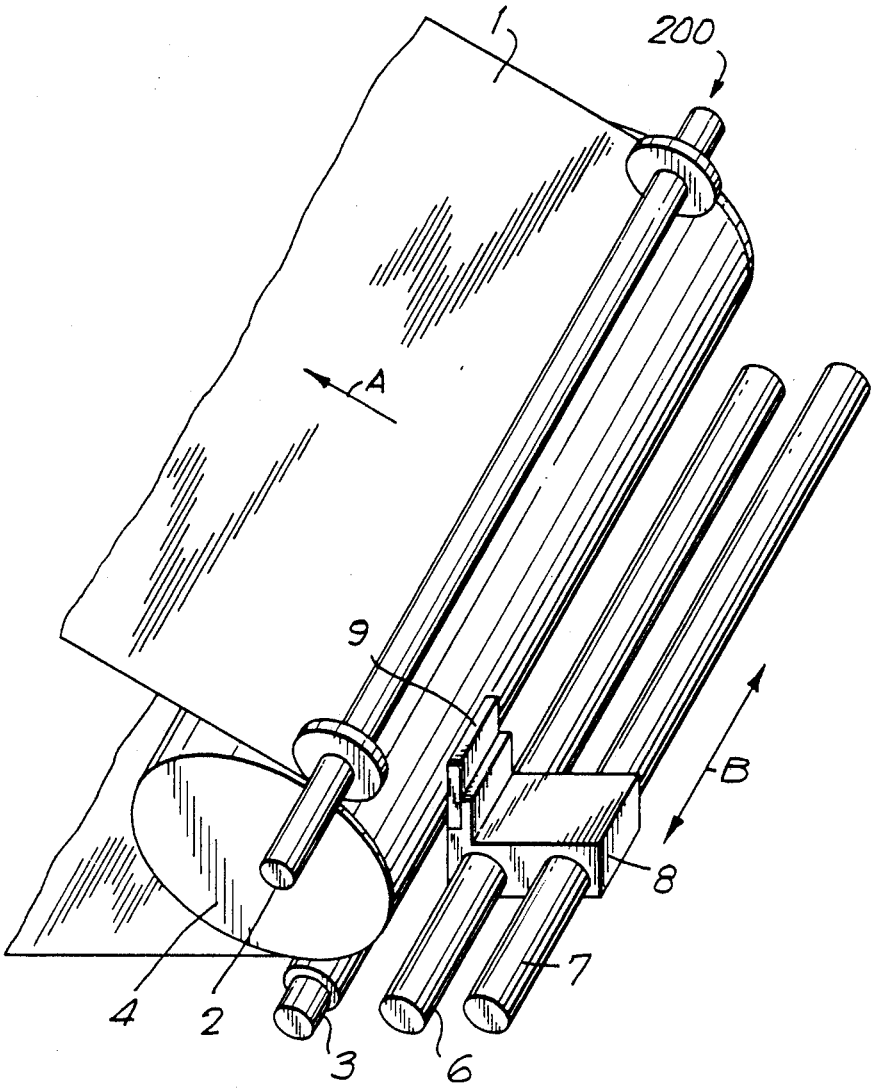
FIG. 1 is a perspective view of an ink jet printer constructed in accordance with the invention.

Reference is first made to FIG. 1 wherein an ink jet printer, generally indicated at 200, constructed in accordance with the invention, is provided. Ink jet printer 200 includes a platen 4, a press feed roller 2 coming in contact with platen 4 and a press feed roller 3 contacting platen 4 upstream from feed roller 2 in the paper feeding direction. Guide shafts 6 and 7 disposed within ink jet printer 200 support a carriage 8 which is movable in a reciprocating direction parallel to platen 4. An ink jet head 9 having a plurality of nozzles capable of independently controlling ejection of ink drops is mounted on carriage 8.

A recording medium 1, such as paper or the like, is wound about platen 4 in the direction of arrow A as maintained about platen 4 by feed rollers 2, 3. Ink jet head 9 scans recording medium 1 in a reciprocating manner in the direction of arrow B and selectively ejects ink drops through each nozzle forming an ink image on recording medium 1.

Figure 2:
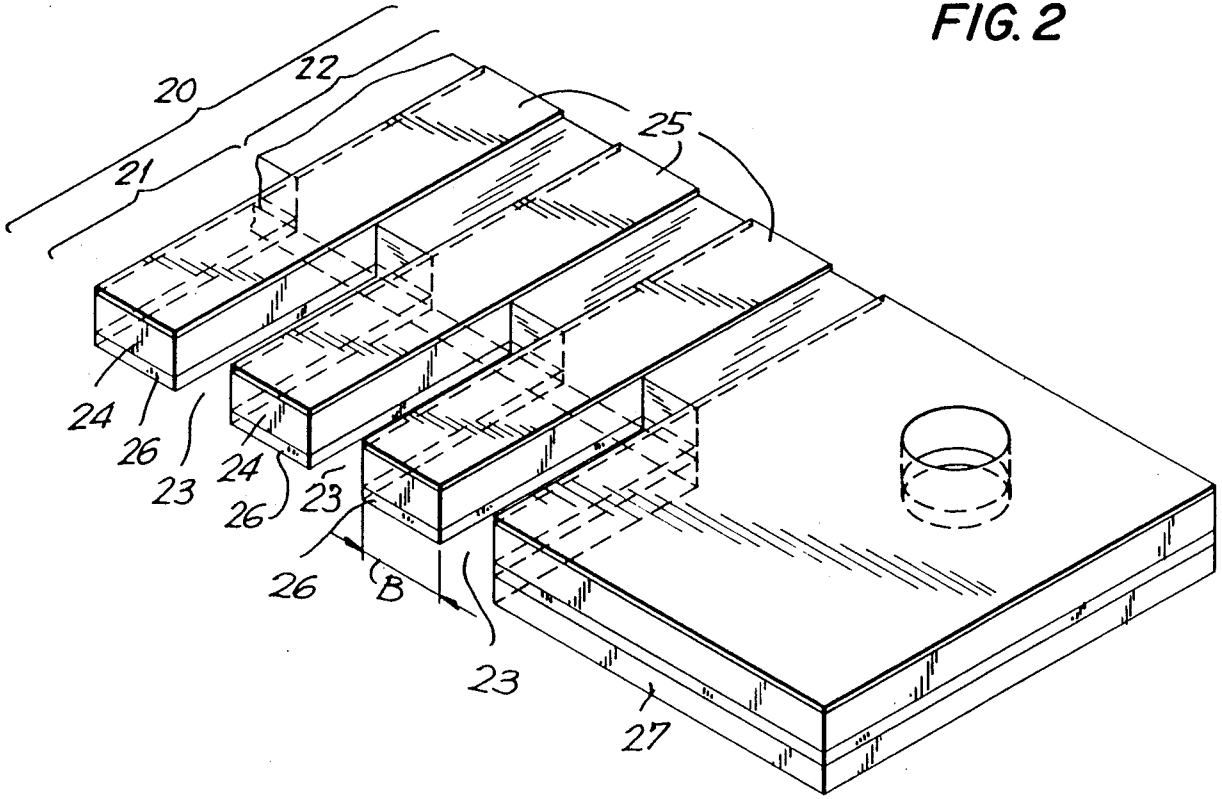
FIG. 2 is a perspective view of a piezoelectric transducer constructed in accordance with the present invention.

Reference is now made to FIG. 2 in which a piezoelectric transducer, generally indicated at 20, positioned within ink jet head 9 is provided. Piezoelectric transducer 20 includes a fixed portion 22 having a plurality of vibrators 21 extending therefrom, each vibrator 21 being separated from an adjacent vibrator 21 by a cut groove 23.

Vibrator 21 is made of a piezoelectric element 24 constructed of PZT. A signal electrode 25 formed of a thin Au layer is built up on one side of piezoelectric element 24. A metallic plate formed of an Ni layer is formed on the opposed side of piezoelectric element 24 and acts as a common electrode 26. A spacer 27 formed of an Ni layer is formed on fixed portion 22.

Figure 3:
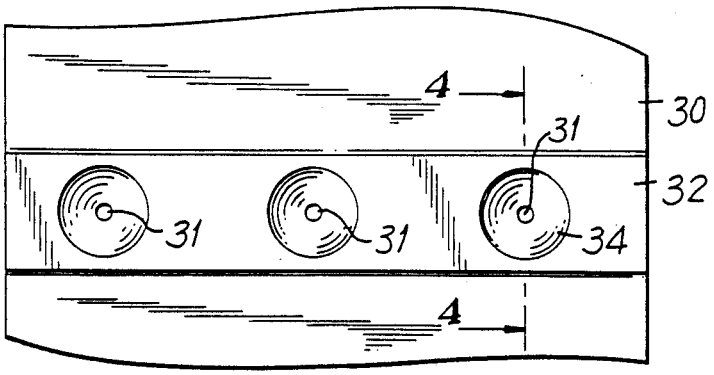
FIG. 3 is a front elevational view of a nozzle forming substrate.
Figure 4:
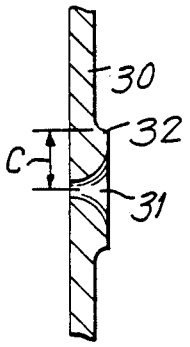
FIG. 4 is a sectional view taken along line 4—4 of FIG. 3.

Reference is now also made to FIGS. 3 and 4 in which a nozzle forming substrate 30, constructed in accordance with the invention is provided. Nozzle forming substrate 30 is formed of a thin Ni plate having a plurality of nozzles 31 formed thereon through electro forming. A bed 32 linking neighboring portions of nozzle inlet openings 34 of nozzles 31 forming a belt is formed by removing all other adjacent areas of substrate 30 through etching. This provides a difference in levels forming bed 32 in the neighborhood of nozzle inlet openings 34 of nozzle forming substrate 30.

Figure 5:
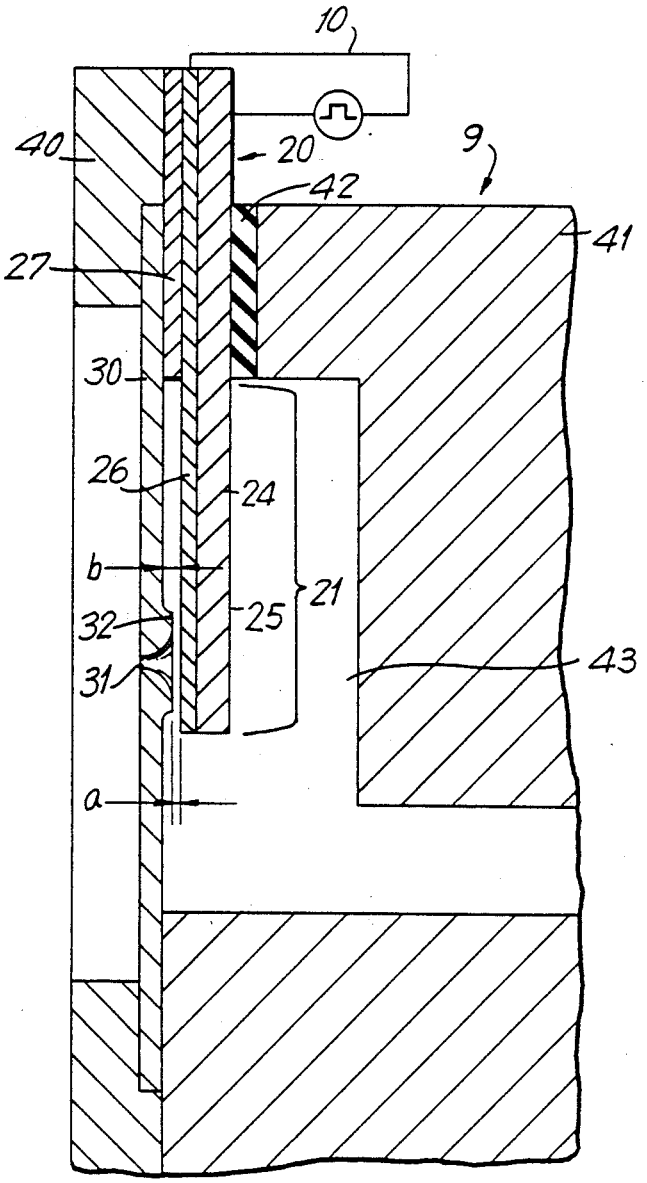
FIG. 5 is a sectional view of an ink jet printer head constructed in accordance with the invention.

Reference is now made to FIG. 5 wherein a sectional view of ink jet print head 9 is provided. Ink jet print head 9 includes a frame 40 and a subframe 41 having an ink reservoir 43 formed therein. Subframe 41 is affixed to frame 40 behind frame 40. Nozzle forming substrate 30, piezoelectric transistor 20 and an elastic seat 42 are disposed between frame 40 and subframe 41. Ink travels from reservoir 43 to feed and fill the area adjacent nozzles 31.

Vibrator 21 of piezoelectric transducer 20 extends within reservoir 43 and is positioned adjacent a nozzle 31. A voltage is applied to piezoelectric transducer 20 by a voltage generator 10.

The direction in which the piezoelectric element 24 is polarized is set so as to contract in a direction orthogonal to the electric field resulting from applying a voltage between common electrode 26 and signal electrode 25. However, because the thin Ni layer 26 joined to piezoelectric element 24 has a high elastic modulus, the dimension change is regulated and when a field is applied to piezoelectric element 24, a bending moment is generated towards signal electrode 25 to cause deformation accordingly. Therefore, by applying a stand-by voltage and selectively removing the voltage, a free end of vibrator 21 is deformed and displaced in the direction of nozzle forming substrate 30 ejecting ink positioned between vibrator 21 and nozzle 31 through nozzle 31.

A gap a formed between vibrator 21 and nozzle 31 is dimensionally adjusted to provide a better ink drop ejection characteristic. A gap b formed between vibrator 21 and nozzle forming substrate 30 in a region away from bed 32 is set to operate vibrator 21 in a proper periodic damping domain to provide a smooth ink feed.

Figure 6:
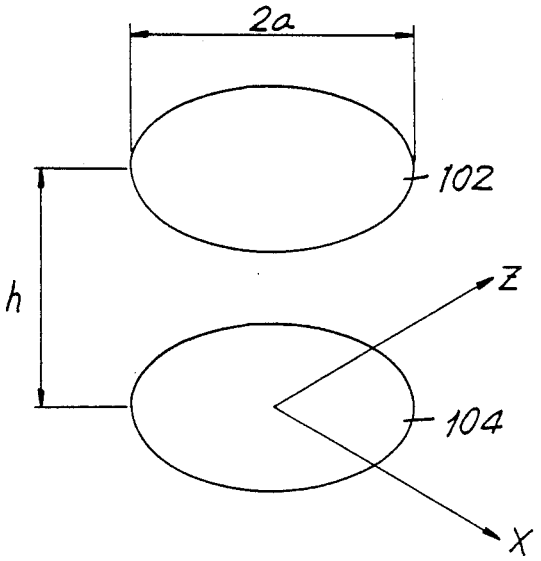
FIG. 6 is a schematic view representing the pressure produced by moving solids within a liquid.

Reference is now made to FIG. 6, wherein a simple model for hydrodynamically demonstrating the pressure generation mechanism and damping mechanism is provided. A first disk 102 and a second disk 104 are moved towards each other at a constant velocity. The pressure generated between the disks 102, 104 may be approximated by the following:

$$P=(3nV/h^3)(X^2+Z^2-a^2)$$

where, n is the fluid viscosity, V is the velocity of the two disks, h is the distance between the two disks, a is the radius of each disk, X is the distance along the X axis, Z is the distance along the Z axis and P is the pressure produced. As can be seen, a peak pressure is generated near the center of the disk and no discernable pressure is generated at a peripheral edge of the disk. Additionally, the pressure value depends largely on the distance between both disks.

In ink jet print head 9, it becomes necessary to control the gap a between nozzle forming substrate 30 and vibrator 21 in the neighborhood of ejection nozzles 31 to efficiently eject ink by generating a high pressure at nozzles 31. Additionally, if the gap is successively small, resistance of ink flow towards the nozzles increases and ink will not be fed satisfactorily. Therefore, gap a (FIG. 4) must be maintained at an appropriate value. A gap b in another region, away from the neighborhood of nozzles 31 formed between nozzle forming substrate 30 and vibrator 21 does not contribute to pressure generation. Then, if the region is larger than necessary, ink flow to nozzles 31 will be prevented and hence the appropriate value exists.

Based upon test results utilizing various vibrator sizes and fluids in various viscosities it has been observed that the dimension of gap a has a maximum value of the vibrator width. In other words, given a vibrator width B (FIG. 2), if a domain of gap a dimensions is expressed by a radius C extending from the center of nozzle 31, then $C \leqq B/2$, and the second gap domain away from the domain B/2 does not contribute to pressure generation of nozzle 31. Accordingly, when considering pressure generation, an ink expelling operation may be efficiently realized by controlling voids in the neighborhood of nozzles 31 and also independently controlling voids in other regions. The gap in regions other than those in the neighborhood of nozzles 31 will be set so as to control fluid resistance and mass load generated on vibrator 21 by fluid flow caused by vibrator 21 displacement. That is, an appropriate periodic damping characteristic will be provided to the vibrator by such controlling of the gaps.

If the gap is larger than the appropriate value, a residual vibration inhibits high speed response, and further, a plurality of ink drops are ejected by a single driving signal (displacement of the vibrator). If the gap is smaller than the appropriate value, then a fluid resistance load becomes obsessive and a large amount of power will be required for displacement of the vibrator 21. Experiments have shown that the fluid resistance load in regions other than the neighborhood of nozzles 31 must be decreased when operating in viscous liquid having a viscosity of greater than 5mPaS. Thus, a gap relationship $a<b$ is preferable and it is desirable that an appropriate fluid resistance load be provided in the region beyond the neighborhood of nozzles 31 against a liquid having a viscosity of no greater than 5mPaS, so that a gap relationship $a>b$ is preferable.

Ink jet print head 9 is designed so that gap b is greater than gap a. The ink viscosity is set at 8mPaS, the vibrator width is 0.3 mm, gap a is 20 μm, gap B is set at 40 μm and the bed domain C is set at 25 mm.

Reference is now made to FIGS. 7a–10b in which several embodiments of nozzles 31 are provided. In a first embodiment in FIG. 7, bed 32 is formed as a circle to enhance ink being feed in an overall circumferential direction by nozzle 31. Bed 3 is formed as a circle confined to the region of substrate 30 adjacent inlet opening 34 of nozzle 31 in contrast to the belt like bed 32 of FIG. 3. As can be seen in FIGS. 8a, 8b, grooves 33 coplanar with the remaining region of nozzle forming substrate 30 are provided radially about bed 32 extending from the center of nozzle 31 to further enhance the feeding of ink. Nozzles 31a, 31c of FIGS. 8a, 10a, respectively, lessen the mutual influence among adjacent nozzles 31a, 31c due to grooves 33a, 33c provided adjacent respective beds 32a, 32c.

In ink jet print head 9, the thickness of spacer 27 of piezoelectric transducer 20 and the height of bed 32 are arbitrarily set, thereby selecting desired gaps a, b. Vibrator 21 is operated in a periodic damping domain, a gap for feeding ink necessary for restoration of a nozzle meniscus after ejecting ink drops is assured by gap b positioned near a fixed end of vibrator 21, thus enhancing ink pressure near nozzle 31. A gap necessary for discharging ink drops is obtained by gap a nearer the free end of vibrator 21. Thus, an efficient ink jet head having a high energy efficiency and simultaneously satisfying the characteristics of ejection rate, ejection quantity and ejection ink drop answerability may be obtained.

In ink jet print head 9, a metallic thin plate formed integrally with the piezoelectric element is used as a spacer. However, a separate metallic thin plate may be inserted and fixed between the nozzle forming substrate and the piezoelectric element as the spacer. Furthermore, a cantilever beam vibrator is used as the vibrator. However, a similar construction may also be realized by using a center beam vibrator. Additionally, the area of the nozzle inlet opening is wider than that of the outlet opening so that the nozzle has the horn like sectional view. However, the nozzle shape is not particularly limited and any nozzle shape may be employed in the invention.

Reference is now made to FIG. 11 wherein a second embodiment of an ink jet printer, generally indicated at 19, constructed in accordance with a second embodiment of the invention is provided. Ink jet print head 19 is similar in construction to ink jet print head 9, the substantial difference being the construction of the transducer. Accordingly, like elements are numbered with like reference numerals.

As seen in FIG. 12, piezoelectric transducer 56 includes a plurality of vibrators 52. Vibrator 52 is formed with a piezoelectric element 24 and a signal electrode 54 formed thereon. A gap control layer 57 is formed on the nose portion of vibrator 52.

Vibrator 52 of ink jet print head 19 is disposed across an infinitesimal gap a opposite a corresponding nozzle 53 near the free end of vibrator 52. A wire 55 is electrically connected to a signal electrode 54 to selectively apply a voltage to piezoelectric transducer 56. Frame 40 is affixed to sub frame 4 by set screws 76, 77 maintaining piezoelectric transducer 56 therebetween.

Reference is now made to FIG. 13, in which an ink jet print head 29, constructed in accordance with a third embodiment of the invention is provided. Ink jet print head 29 includes a nozzle forming substrate with a plurality of nozzles 61 formed therein. Nozzle forming substrate 60 is made of a metallic thin plate and having a region 60*a* formed around nozzle 61 formed thicker than the surrounding regions of nozzle forming substrate 60.

A vibrator 62 is disposed opposite each corresponding nozzle 61 across an infinitesimal gap a near the free end of vibrator 62. Portion 60*a* is formed opposite the free end of vibrator 62.

A groove 64 is formed on a portion of nozzle forming substrate 60 opposite the neighborhood of the fixed end of vibrator 62. Accordingly gap b in the neighborhood of the vibrator fixed end and gap a in the neighborhood of the vibrator free end are determined by the thickness of a spacer 65 positioned between frame 40 and vibrator 54 and the depth of groove 64 formed in nozzle forming substrate 60. Thus, the gap for using the vibrator 62 in a periodic damping domain is obtained by gap b, and the gap necessary for ejecting ink is obtained by gap a.

Reference is now made to FIG. 14, in which an ink jet print head, generally indicated at 39, constructed in accordance with a fourth embodiment of the invention is provided. Ink jet print head 39 includes a frame 70, a subframe 71 fixed to frame 70 by set screws 76, 77. A nozzle plate 72, a spacer 73, a piezoelectric transducer 74 and an elastic seat 75 are supported between frame 70 and subframe 71. Nozzle plate 72 has a plurality of nozzles 78 formed therein. Nozzle plate 72 is formed of a thin metallic plate. Subframe 71 has an ink reservoir 80 formed therein and a heater positioner 79 mounted thereon for heating the ink jet head to a working temperature and dissolving melted ink within the ink reservoir 80 and the region formed around piezoelectric transducer 74 to convert the heat meltable ink to a liquid phase.

Reference is now made to FIG. 15, wherein a perspective view of the piezoelectric transducer 74 is provided. Piezoelectric transducer 75 has a fixed portion 82 and a plurality of vibrators 81 extending therefrom, vibrators 81 being separated from adjacent vibrators 81 by cuts 85. Each vibrator 81 has a piezoelectric element 83 formed of PZT. A single electrode 84 formed of a thin Au layer is formed on the one side of piezoelectric element 83 and a common electrode 85 formed of a thin Ni layer is formed on the opposed side of piezoelectric element 84. Piezoelectric element 84 is joined to common electrode 85 by solder having a fusing point of 140° C. and a melting point of about 160° C. which is higher than the working temperature of the ink.

Ni which forms the common electrode 85 has a greater coefficient of linear expansion than piezoelectric element 83. Accordingly, a bending moment caused by the bi-metal effect is generated in an environment of 110° C. which in effect is the working temperature. Accordingly, a dish-like warp is formed on the common electrode 85 having a curvature of $R^{-1}$. Curvature of the piezoelectric element towards common electrodes 85 is shown in FIG. 14.

The coefficient of linear expansion for piezoelectric element 83 and Ni used in piezoelectric transducer 74 are $0.8\times10^{-6}\ K^{-1}$ and $12.8\times10^{-6}\ K^{-1}$, respectively. Where the span of the cantilever beam is 3 mm and the curvature has a curvature of $R^{-1}=6.0m^{-1}$ and a radius of curvature R=166.7 mm at a temperature difference of 50° C., 27 μm warp y (shown in FIG. 13) is obtained.

Piezoelectric transducer 74 is tightly fixed to nozzle forming substrate 30 to keep it tangent to the fixed end of vibrator 81 and keep vibrator 81 parallel with nozzle substrate 72. The free end of a vibrator 81 is disposed opposite to each corresponding nozzle 78 across an infinitesimal gap produced by warp y in piezoelectric transducer 74. Accordingly, piezoelectric transducer 74 has its fixed end locked between frame 70 and subframe 71 through spacer 73 and elastic seat 75. Therefore, any warp within the fixed portion of 82 of piezoelectric transducer 74 is pushed on frame 70 through spacer 73 thus flattening the fixed end of piezoelectric transducer 74. Consequently, an internal stress is generated within vibrator 21. However, vibrator 21 is designed to operate within a permissible stress range caused by having a fixed end portion shortened in length, thereby preventing damage to vibrator 21.

A wire 86 is electrically connected to individual signal electrodes 84 to selectively apply a voltage thereto. A common electrode 85 is independently provided at each vibrator 21 but mutually electrically connected due to the use of Ni as the material for spacer 73 and Al or Zn for die casting frame 70.

A hot melt ink contained within ink reservoir 80 is fed about nozzle 78. A voltage is applied to vibrator 81 causing vibrator free end 88 to be displaced discharging ink from nozzle 78.

In ink jet print head 39 gap b which provides an appropriate periodic damping domain for vibrator 81 is obtained by the thickness of spacer 73. Warp y is produced at the free end of vibrator 81 as a result of the bi-metal effect obtained through securing two elements together, each element having a different coefficient of linear expansion than the other. Therefore, gap a formed between nozzle 78 and the neighborhood around the free end of vibrator 81 which causes ink ejection is obtained by locking the fixed end of vibrator 81 to nozzle plate 72 through spacer 73. When an electric signal is applied to vibrator 81, periodic damping has a long time constant, so that the ink ejection pressure can be maximized and the time required for obtaining the maximum ejection pressure may be shortened. Further, even when a member having a different coefficient of linear expansion is formed on the vibrator, because the working temperature is controlled by using a hot melt ink, warp fluctuations attributable to the bi-metal effect produced by a change in environmental temperature can be prevented.

Reference is now made to FIGS. 16*a*, 16*b* in which a vibrator 90 constructed in accordance with an alternate embodiment of the invention is provided. A piezoelectric transducer 89 (FIG. 17) has a plurality of vibrators 90 extending from a fixed portion (not shown). Vibrator 90 is formed of a piezoelectric element 91 having a thin Au layer built up on one side forming a signal electrode 92 and a metallic plate formed of an Ni layer on the opposed side acting as a common electrode 93. The free end of vibrator 90 which is positioned across from the nozzle of the ink jet print head is thickened by a circular projection 94 built on common electrode 93.

Reference is now made to FIG. 17, wherein an ink jet print head, generally indicated at 49, constructed in accordance with a fifth embodiment of the invention is provided. Ink jet print head 49 is similar to ink jet print head 9, with piezoelectric transducer 20 being replaced by piezoelectric transducer 89. The like structural elements are indicated by like numerals.

Gap a between circular projection 94 formed on vibrator 90 and a nozzle forming substrate 95 is dimensioned to enhance the ink drop discharge characteristic. Gap b formed between nozzle forming substrate 95 and a portion of vibrator 90 upon which circular projection 94 is not present is dimensioned independently from gap a so that vibrator 90 operates in an appropriate periodic damping domain and ink is smoothly fed circumferentially towards nozzles 31.

Reference is now made to FIGS. 18*a* through 20*b*, wherein alternative configurations in circular projection 94 are provided. In FIGS. 18*a*, 18*b* grooves 96 are provided in circular projection 94. Grooves 96 are coplanar with common electrode 93 and extend radially from an axis which would be coaxial with nozzle 31 to further enhance ink feeding. Vibrators 90*b* and 90*c* are provided with fewer radial cuts 96*a*, 96*b*, respectively, which lessens the mutual influence between adjacent nozzles.

Reference is now made to FIGS. 21*a* and 22 in which a nozzle forming substrate generally indicated at 100, constructed in accordance with a sixth embodiment of the invention is provided. Gap a formed between vibrator 20 and the region of nozzle forming substrate 100 adjacent nozzles 101 and gap b formed between vibrator 20 and nozzle forming substrate 100 away from nozzles 101 has a relationship set as follows:

$$a>b$$

This embodiment is particularly applicable to uses involving low viscosity ink. Nozzle forming substrate 100 is produced through electro forming and therefore is constructed of a generally uniform thickness.

As seen in FIG. 25, an electrolytic plated layer 203 is formed on a master with a conductor pattern 202 formed on an insulator 201. Electrolytic plated layer 203 is coated with a resist layer 204 and electrolytic plated layer 205 is formed on the plated layer which is partly exposed through patterning thus obtaining an electro forming die having a desired nozzle hole and level difference. An electrolytic plated layer is formed by the die and is then removed from the die to produce nozzle forming substrate 100. By forming a nozzle forming substrate 100 which is stepped, a region extending from nozzle 1? 1 having a length C is controlled by gap a and the remaining region is controlled by gap b.

Reference is now made to FIGS. 23, 24 in which a nozzle forming substrate 110 constructed in accordance with a seventh embodiment of the invention is provided. As can be seen from FIG. 24, nozzle forming substrate 110 is again formed in a stepped construction, however, the region in the neighborhood of nozzle 111 having a radius C' is hollowed and set back from the remaining region 110*a* of nozzle forming substrate 110 so that gap a and gap b have the following relationship:

$$a>b$$

This example is also applicable to the use of low viscosity ink.

By providing a gap adjacent the nozzle inlet opening of a nozzle forming substrate which is different from the gap between the vibrator and the remainder of the nozzle forming substrate, the gap between the vibrator and the nozzle forming substrate adjacent the nozzle being minute to eject ink adjacent the nozzle and provide a feed passage of ink necessary for restoring a nozzle meniscus after the ink has been discharged, the time required for ink to return to an ejectable position is properly controlled, therefore ink answerability can be enhanced while keeping ink drop ejection rate and ejection quantity at a desired level. Additionally, by providing a gap between the vibrator and the nozzle forming substrate set to a value where the vibrator is capable of operating in appropriate periodic damping in an area other than adjacent the nozzle, energy consumption due to the viscosity of the ink existing in a gap formed between the vibrator and nozzle forming substrate is decreased and because the size of the gap between the vibrator and the nozzle forming substrate can be independently set in the region adjacent the nozzles, a margin for setting its sides is expanded to enhance projection yield.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink jet print head for ejecting ink onto a recording medium comprising a frame, an ink supply, a nozzle forming substrate supported on the frame and having a plurality of nozzles formed therein, a piezoelectric transducer having a plurality of vibrators thereon, each vibrator being in direct contact with the ink and independently driven, the piezoelectric transducer being supported on the frame so that a vibrator is in facing relationship with the nozzle forming substrate forming a first gap between the vibrator and a region of the nozzle forming substrate adjacent to the nozzle and a second gap formed between the vibrator and a region of the nozzle forming substrate away from the nozzle, the width of the first gap being different from the width of the second gap, the first gap having a width for controlling the pressure generated therein, the second gap having a width for controlling the vibration of each vibrator and ink supply, and the width of the first gap being less than the width of the second gap when the viscosity of the ink is greater than 5 mPaS and the width of the first gap being greater than the width of the second gap when the viscosity of the ink is no greater than 5 mPaS.

2. The ink jet print head of claim 1, wherein each vibrator has a first end and a second end, the first end being supported and fixed relative to said second end, the first gap extending towards said first end for a length no greater one half the width of the vibrator, the second gap having a length extending from the first end to the termination of the first gap.

3. The ink jet print head of claim 1, wherein said nozzle forming substrate is formed with a groove therein extending from the region of the nozzle forming substrate adjacent the nozzle to a region of the nozzle forming substrate adjacent the first end of the vibrator.

4. The ink jet print head of claim 1, wherein the nozzle forming substrate includes a bed, the nozzles being formed within the bed.

5. The ink jet print head of claim 4, wherein the bed is formed as a belt connecting adjacent nozzles formed therein.

6. The ink jet print head of claim 4, wherein the bed is formed as a circular region formed about each nozzle.

7. The ink jet print head of claim 6, wherein the bed is formed with at least two grooves therein.

8. The ink jet print head of claim 4, wherein said vibrator is formed with a circular projection on a region of the vibrator disposed opposite the nozzle.

9. The ink jet print head of claim 1, wherein each vibrator is formed of a piezoelectric element, a signal electrode formed on the piezoelectric element and a common electrode formed on the opposed side of said piezoelectric element from said signal electrode.

10. The ink jet print head of claim 9, further comprising a gap control layer formed on the vibrator in facing relationship with the nozzle.

11. The ink jet print head of claim 1, wherein the nozzle forming substrate is formed as a step construction, whereby the region of the nozzle forming substrate adjacent the nozzle is farther from the vibrator than the remaining region of the nozzle forming vibrator.

12. An ink jet print head for ejecting ink onto a recording medium comprising a frame, a nozzle forming substrate supported on the frame and having a plurality of nozzles formed therein, the nozzle forming substrate including a bed, the nozzles being formed within the bed, a piezoelectric transducer having a plurality of vibrators thereon, each vibrator being formed with a circular projection on a region of the vibrator disposed opposite the nozzle, each vibrator being independently driven, the piezoelectric transducer being supported on the frame so that a vibrator is in facing relationship with the nozzle forming substrate forming a first gap between the vibrator and a region of the nozzle forming substrate adjacent to the nozzle and a second gap formed between the vibrator and a region of the nozzle forming substrate away from the nozzle, the width of the first gap being different from the width of the second gap, and said circular projection being formed with at least two grooves therein.

13. The ink jet print head of claim 11, wherein said grooves extend radially from the center of said circular projection.

14. An ink jet print head for ejecting ink onto a recording medium comprising a frame, a nozzle forming substrate supported on the frame and having a plurality of nozzles formed therein, the nozzle forming substrate including a bed, the nozzles being formed within the bed and a piezoelectric transducer having a plurality of vibrators thereon, each vibrator being independently driven, the piezoelectric transducer being supported on the frame so that a vibrator is in facing relationship with the nozzle forming substrate forming a first gap between the vibrator and a region of the nozzle forming substrate adjacent to the nozzle and a second gap formed between the vibrator and a region of the nozzle forming substrate away from the nozzle, the width of the first gap being different from the width of the second gap, and said circular projection being formed with two opposed grooves formed therein, said grooves extending radially from the center of said projection.

* * * * *